US005664387A

United States Patent [19]

Bhatti

[11] Patent Number: 5,664,387

[45] Date of Patent: Sep. 9, 1997

[54] MODULAR BLOCK CONSTRUCTION SYSTEM

[76] Inventor: Khaqan Bhatti, #3 Foxcroft La., Pine Bluff, Ark. 71603

[21] Appl. No.: 669,146

[22] Filed: Jun. 24, 1996

[51] Int. Cl.[6] ..... A63H 33/08

[52] U.S. Cl. ..... 52/604; 52/585.1; 52/592.1; 52/592.6; 52/605; 446/102; 446/108; 446/115; 446/121; 446/122

[58] Field of Search ..... 52/604, 605, 592.6, 52/592.1, 585.1; 446/102, 108, 115, 121, 122

[56] References Cited

U.S. PATENT DOCUMENTS

| | | | |
|---|---|---|---|
| 246,129 | 10/1881 | Klamer . | |
| 285,222 | 8/1883 | Nakata . | |
| 301,260 | 5/1884 | McLaughlin et al. . | |
| 309,638 | 7/1884 | Meyer . | |
| 3,422,588 | 1/1969 | Stewart, Jr. . | |
| 3,611,620 | 10/1971 | Perry | 446/121 |
| 3,651,597 | 3/1972 | Daenen . | |
| 3,919,785 | 11/1975 | Generaux . | |
| 4,246,718 | 1/1981 | Chatani . | |
| 4,551,110 | 11/1985 | Selvage et al. | 446/122 X |
| 4,676,762 | 6/1987 | Ballard . | |
| 4,919,268 | 4/1990 | Young et al. | 446/122 X |
| 5,215,490 | 6/1993 | Szoradi | 446/115 |
| 5,411,428 | 5/1995 | Orii et al. | 446/102 X |

*Primary Examiner*—Christopher Todd Kent

*Attorney, Agent, or Firm*—Stephen D. Carver; Trent C. Keisling

[57] ABSTRACT

A modular block construction system comprises blocks and other accessory parts that dynamically fit together to form different items of varying forms and shapes. One or more blocks of various sizes have outer, peripheral edges that can be mated with one another, or snap fitted to accessories including walls and wedges. Each cubicle block comprises six intersecting panels that have peripheral edges that alternate with pairs of spaced apart nubs and sockets that enable the panels to be orthogonally assembled. Outwardly projecting panel sides of assembled blocks can be snap fitted to abutting sides of other blocks. Spider connectors captivated within the blocks transform each connecting surface between male, female, and flattened configurations. Radially spaced apart follower slots are defined in the sides. Movable spiders captivated within the blocks have arms slidably received by and constrained within the slots. The spiders are exteriorly accessible by the user who can touch exposed spider arm tips projecting from the block sides through the slots. Each panel comprises a plurality of identical quadrants separated from one another by the elongated follower slots. The spiders each have projections that variably penetrate orifices in the block panels.

20 Claims, 8 Drawing Sheets

MODULAR BLOCK CONSTRUCTION SYSTEM

BACKGROUND OF THE INVENTION

I. Field of the Invention

The present invention relates generally to modular block systems. More particularly, the present invention relates to dynamic block systems and accessories that can be assembled as desired to construct a variety of structural items.

II. Description of the Prior Art

In the prior art a variety of modular, structural systems comprising blocks and the like are known. Such systems have numerous applications. In the construction arts, for example, such modular systems may be employed for building a variety of architectural walls, partitions, and other static structures. Block systems can also be employed for modeling larger structures, and for amusement.

Various forms of generally cubicle models are useful to artists, educators, architects and inventors to present their ideas quickly and in a more concrete way. Further, children can use interfitting modular structures to build a variety of toy shapes. With relatively large interfitting blocks, it is well known that certain temporary or permanent building structures can be economically constructed. Such block systems enable the designer or architect to custom conform the structure to the architectural plans or to the realities of the job site.

Prior inventions have failed to provide a generalized, three dimensional building block interconnecting and locking system in which connecting structure can be dynamically varied. Known prior art block systems lack flexibility, since most known systems omit structure that concurrently provides both male and female parts. For example, male projections of known systems can interfere structurally with female receptors. In other words, projecting male structures often obstruct access to corresponding female connection points when desired to dispose the system in certain configurations.

One problem with prior art modular systems is that block faces are not flat. Usually static projecting structures form the male connector. When female connection points are established, the outwardly projecting male connectors can interfere with assembly.

To maximize the versatility of a modular block system, it must be possible to configure blocks to present flat faces when desired. A system characterized by dynamically deployable male connectors would be most advantageous for minimizing interference. Further, an ideal system must provide interconnections that cooperatively strengthen and support each at each interconnection. Instead, many prior art block systems weaken the structure being built with numerous joints or connection points that diminish module integrity. For example, when prior art cubical blocks are connected to each other to form a round or curved structure, substantial weakening results.

SUMMARY OF THE INVENTION

I have invented a new Modular Block Construction System comprised of numerous parts that can be snap fitted together to make various diverse items of different forms and shapes. In the best mode my system includes one or more blocks of various sizes having outer surfaces that can be snap fitted to one another. The blocks can be used with optional wedges and wall segments to result in numerous configurations.

The preferred block is cubicle, comprising six intersecting panels forming sides adapted to be fitted to similar sides of other blocks. Internal spider connectors captivated within the blocks are activated to juxtaposition each block surface between male, female, and flattened orientations. There are radially spaced apart follower slots in the sides. Internally movable spiders within the blocks have arms projecting slidably received within the slots. The spiders are moved by the user who grasps exposed tips on the block sides.

Preferably each panel comprises a plurality of identical, quadrants separated from one another by elongated follower slots. Each quadrant has beveled panel edges that border the slots, and radially spaced apart connector orifices disposed at each center corner. Preferably the beveled panel edges alternately comprise pairs of nubs and sockets that enable the panels to be orthogonally assembled to form the blocks. Nubs from one panel are snap fitted within the sockets from another along the peripheral edges of the panels.

Each quadrant comprises a raised, diagonally extending middle segment, disposed between integral, lower side segments. Outer connection orifices are diagonally aligned with the inner connection orifices controlled by the spiders.

Each spider comprises an inner hub from which radially spaced-apart, and offset arms outwardly project. These arms are offset between differently sized edge segments of the hub for clearance purposes. In this manner, when the spiders are assembled within a block, the internally, orthogonally projecting spider arms clear one another. The arms penetrate the panel follower slots, terminating in activation buttons manipulable from the block exterior.

Each control spider preferably comprises four, spaced apart control projections at the hub corners. The spider projections dynamically, variably obstruct the panel connection orifices. When spider movement retracts the control projections, the connection orifices are unblocked and they may be mated to control projections extending from other blocks. When spider movement partially activates the projections the panel exterior is "flattened".

Thus an important object of my invention is to provide a plurality of interconnectable blocks with dynamically variable connectors.

In other words, it is an important object to provide a modular block structure of the character described whose connector structures upon block faces are dynamically variable.

An important object is to provide a modular block system with the blocks described that incorporates controls for varying male and female connecting structure to flatten the faces of connecting blocks. An important feature of the invention is that any one of the six sides of the preferred cubical block can become a male projection, a female recession or a relatively flat, neutral surface independently of the other five surfaces.

Another basic object of my invention is to provide a plurality of blocks and related accessories that can be quickly assembled into a wide variety of interconnecting, interlocking, three-dimensional structures.

A related primary object is to provide a modular system comprising interconnecting, removable blocks and parts that can be conveniently and quickly arranged by the user into architectural or construction models.

Another important object is to provide a plurality of interconnecting blocks formed of panels that can be orthogonally snap fitted to one another.

A related object is to provide a modular block system in which irregular blocks with unequal faces can be "face flattened" with easy controls.

A still further object is to provide blocks for a modular system in which each and every face of every block is independently capable of assuming a connective male or receptive female configuration.

A related object is to provide a system of the character described that enables the construction of numerous items with relative ease and flexibility.

A further general object is to provide a block system that enhances artistic flexibility.

Another objective of this invention to enable the artist or other user of the block system to let their imagination fly and to build models and figures with relative quickness.

A further object is to provide a block system that allows an architect to quickly build a model to enable his or her customer to visualize a desired house or structure.

A further object is to enable a model builder to quickly and non-destructively modify a model to accommodate customer changes and afterthoughts in a timely manner.

Another object is to provide a building block system that is functional with cubes or other parallelepipeds.

Another object is provide a modular block system of the character described that enables the artistic modeling of various figures, that accommodates accessories including eyes, hands, wheels of a toy vehicle, plants, and other geometrically diverse objects that have been provided with the connecting design of the blocks.

Another object is to provide a system adapted for constructing either temporary or permanent walls, partitions, buildings and the like.

Yet another object of my invention is to provide components for the system of different colors, thus enhancing artistic expression and ease of use.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
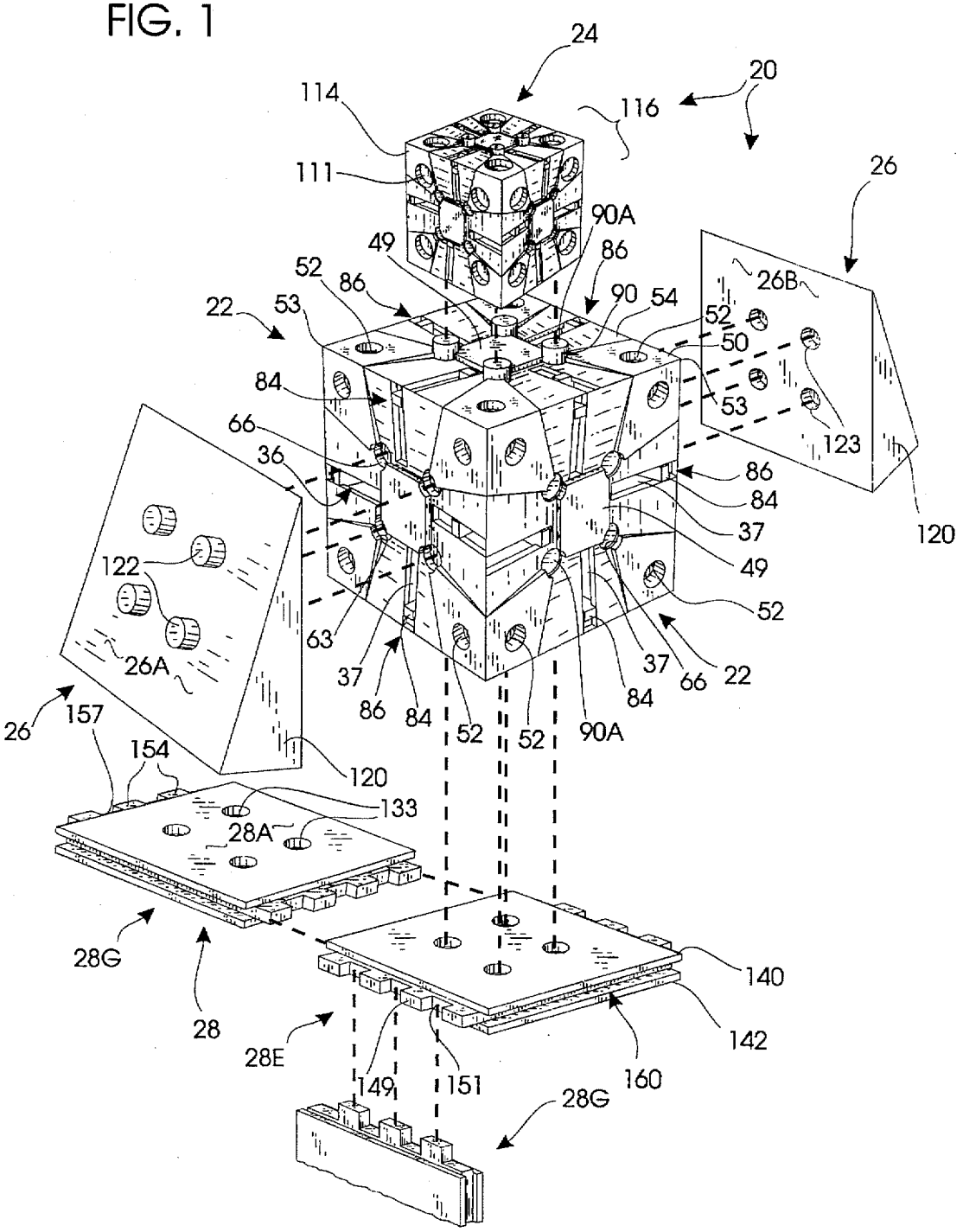
FIG. 1 is a partially exploded and partially fragmentary, isometric assembly view illustrating the preferred Modular Block Construction System, with the system deployed in one possible configuration with a large block connected to an upper smaller block, a pair of opposed wedges, and a quartet of lower wall segments.

With attention now directed initially to FIG. 1 to the accompanying drawings, the reference numeral 20 broadly designates my proposed Modular Block Construction System. In the best mode the system is comprised of numerous parts that can be assembled together in three dimensions, both vertically and horizontally, to provide desired models or structures. One possible arrangement of parts is seen in FIG. 1, although, as will become clear hereinafter, a variety of configurations are possible.

In the best mode, system 20 comprises one or more blocks 22 to be hereinafter described, that are similar to one or more smaller blocks 24 that are virtually identical structurally to blocks 22 Preferably the smaller blocks are one half the dimensions of the larger blocks. Each block 22 or 24 is configured to fit to either larger or smaller blocks of different dimensions. The system also comprises wedges 25 that can be snap-fitted to blocks 22 or other wedges as will hereinafter be described. With a plurality of such wedges mounted in the manner suggested by FIG. 1, a user of system 20 can make several differently shaped items. Finally, the system may comprise wall segments 28 of generally planar configuration that will be described hereinafter. When a plurality of wall segments 28 are coupled together as illustrated, they can form a planar surface of a desired size, they can be wrapped around a block, or they can project vertically from one another. They may be snap-fitted either to the wedges 26 or to the blocks 22 for purposes hereinafter described.

With joint reference now to FIGS. 1–4, each block 22 is generally in the form of a parallelepiped. In the best mode each block is cubical. Of course, the block could be variously configured in the form of other regular parallelepipeds, having, for example, rectangular sides. Each block 22 comprises, in the best mode, six identical panels 30 that are orthogonally arranged to form the surfaces of a cube. As explained in detail later, panels 30 may be fastened together at their edges by fitting the peripheral panel edges together. The block interior 23 (FIGS. 1, 3) defined between the panels internally houses three pairs of movable spider connectors.

Figure 4:
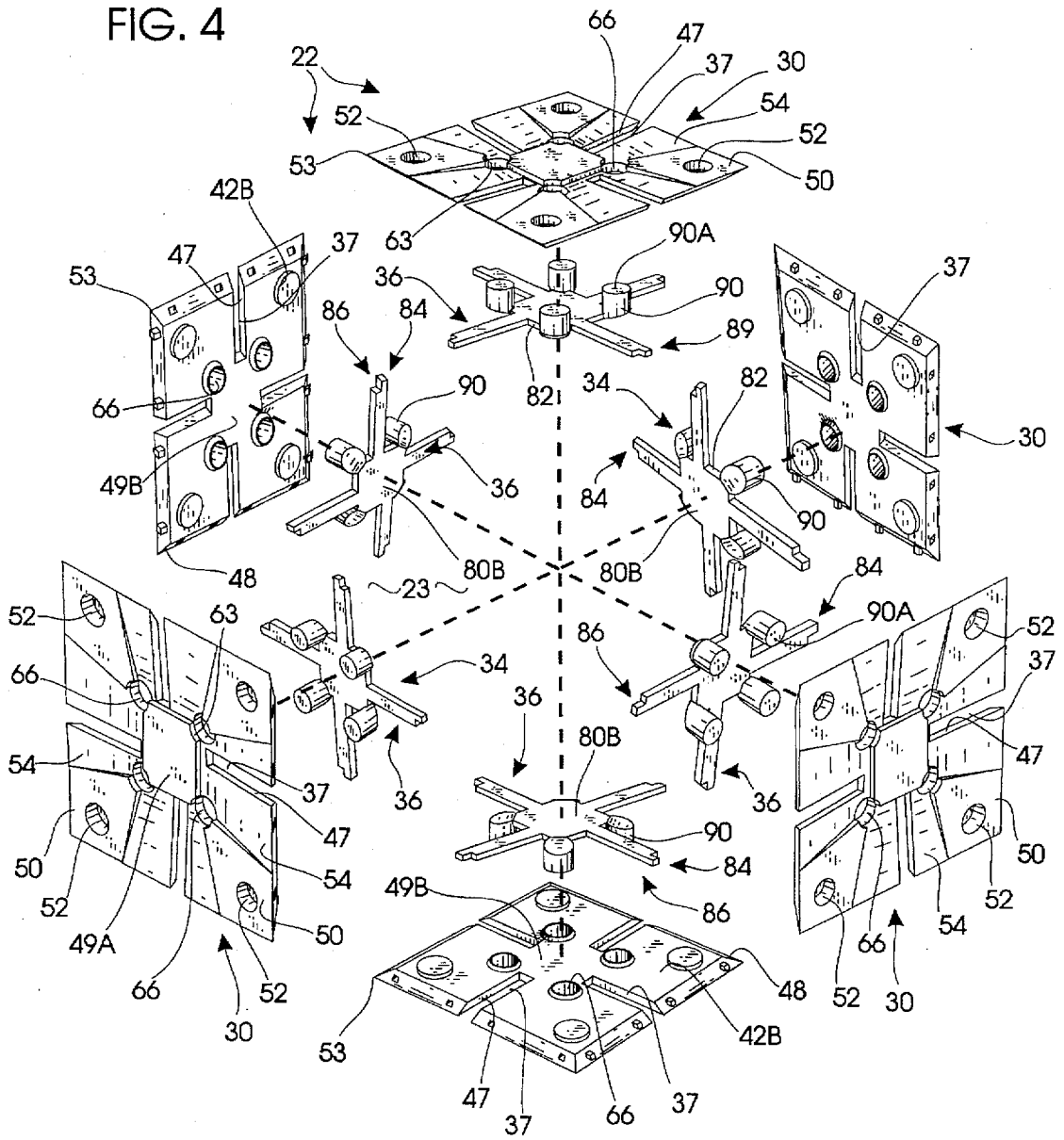
FIG. 4 is an exploded, isometric view of the preferred block.

As best viewed in FIG. 4, the internal spider connectors comprise radially spaced apart, offset arms 36. These arms project towards the block exterior, and they interiorly clear one another when assembled as seen in FIG. 4. Spider arms 36 project into and slide within radially spaced-apart follower slots 37 defined within each panel 30. As explained in detail hereinafter, the spiders may be dynamically manipulated by the user to flatten the exposed faces of the blocks 22 or engage orifices in other blocks, wedges, or the like. Mounting projections on other blocks are furnished when spiders captivated therewithin are moved appropriately.

Figure 5:
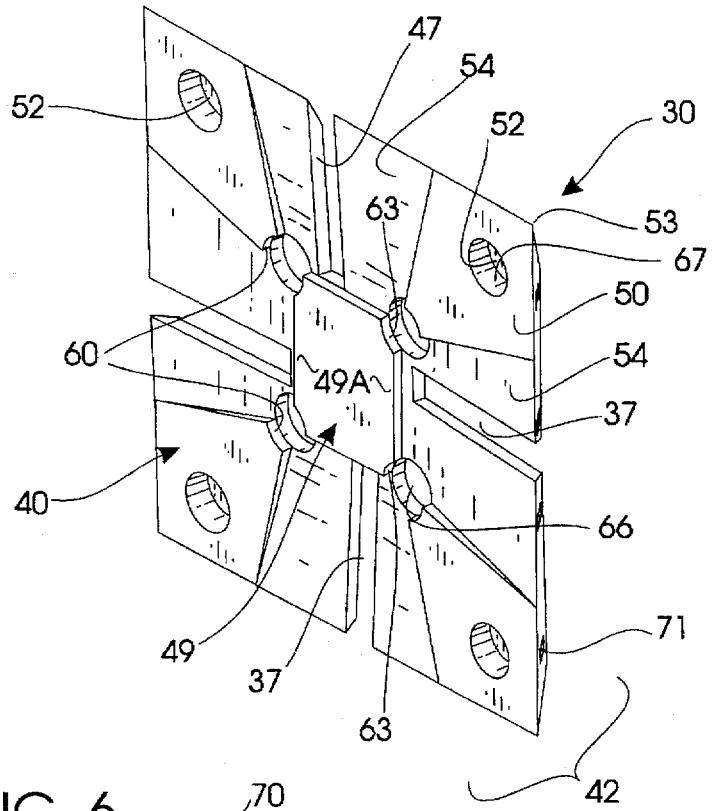
FIG. 5 is an enlarged, front isometric view of a preferred block panel, showing its normally outwardly projecting face.

The outermost face of a panel 30 has been designated by the reference numeral 40 (FIG. 5). The innermost face of each panel, which faces the viewer in FIG. 6, has been designated by the reference numeral 41. In the best mode, each panel comprises a plurality of identical, radially spaced-apart quadrants 42. Each panel quadrant is separated from an adjacent quadrant by panel follower slots 37. Each quadrant 42 is generally rectangular, and is bounded by a pair of beveled panel edge segments 45 and 46 that are separated by a corner 48. Pairs of aligned edge segments on the panels form edges that are to be connected to similar edges of orthogonally connected panels. Edge segments (FIG. 6) forming one complete edge of a panel preferably comprise either a pair of outwardly projecting nubs 170 or recessed sockets 171. During assembly, when edges of panels are fitted to one another, the nubs in one panel edge are snap fitted within the sockets in the abutting panel edge. Preferably, interior edges 47 of each quadrant are spaced from similar beveled edges of adjacent quadrants on opposite sides of the follower slots 37.

Figure 6:
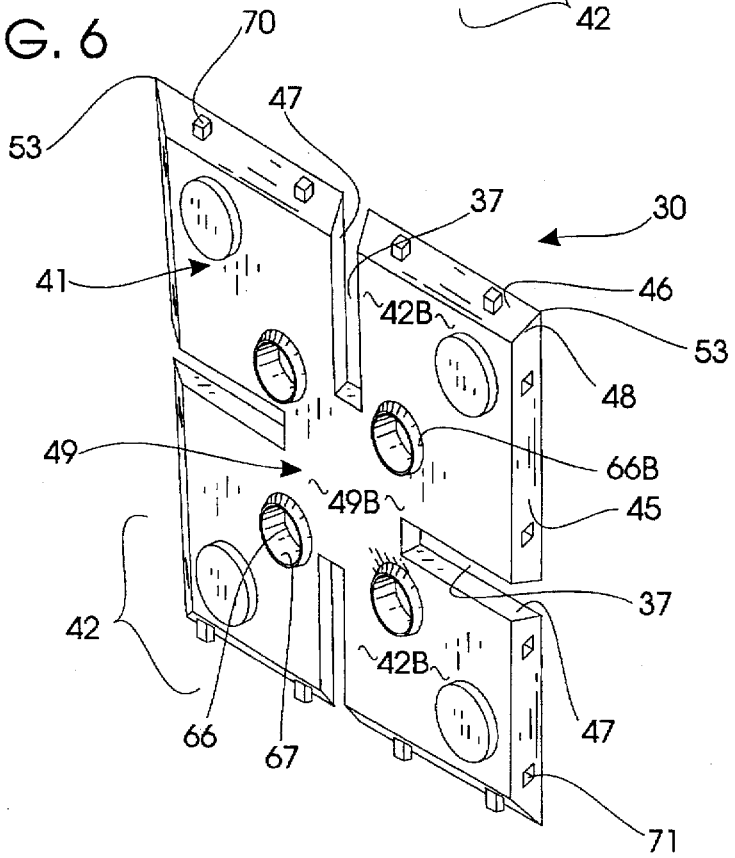
FIG. 6 is an enlarged, rear isometric view of a preferred block panel, showing its normally inwardly projecting face and the peripheral panel edges.

All of the panel quadrants are integral with and are radially positioned about a solid, panel center 49. The outwardly facing surface 49*a* (FIG. 5) of panel center 49 is offset relative to the neighboring connection orifice 66 adjacent the corners of panel center 49 (FIGS. 5, 6). The opposite inner surface 49*b* of the center 49 is flat and contiguous with the inner surfaces 42*b* of each quadrant. Connection orifices 66 are defined at each inner, arcuate corner of the center 49.

As best viewed in FIG. 5, each quadrant comprises a middle segment 50 that extends diagonally from a quadrant corner vertex 53 to a generally curved and offset terminus 60. Curved terminus 60 is offset from quadrant sections 54. A terminus 60 is disposed immediately diagonally opposite a similar offset and arcuate terminus 63. Each corner of the square panel center 49 terminates in an arcuate terminus 63 adjacent the connection orifices 66. The connection orifices 66 extend all the way through the panel for engagement by spider control projections 90 (FIGS. 7, 8) to be described hereinafter. The orifices 66 define a raised, circumferential ring 66B (FIG. 6) that circumscribes a tubular passageway 67.

Corner orifices 52 extend only about half-way through quadrant portions 50 as determined by a comparison of FIGS. 5 and 6. Orifices 52 are diagonally aligned with connection orifices 66. The combination of outer orifices 52 and inner orifices 66 enables each block to be connected to a smaller or larger block (i.e., FIG. 1) as explained hereinafter.

As best viewed in FIG. 5, each quadrant outermost surface comprises a raised central portion 50 of generally trapezoidal shape. The depth of each central quadrant portion 50 is preferably constant from corner vertex 53 to the central receptor orifice 66. They are penetrated by the radially spaced apart, outer corner orifices 52. Portions 50 are preferably bordered on both sides by integral recessed segments 54 that extend between the follower slots 37 and the central quadrant portions 50. Since adjacent segments 54 of different quadrants bordering a follower slot 37 are recessed, the spiders that extend through the slots 37 can be touched for manual activation.

Figure 7:
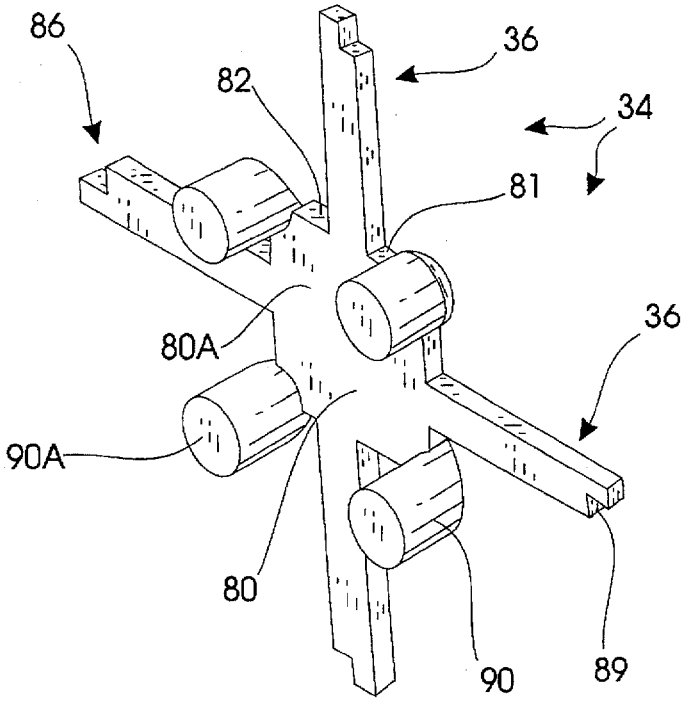
FIG. 7 is an enlarged front isometric view of a preferred spider connector.
Figure 8:
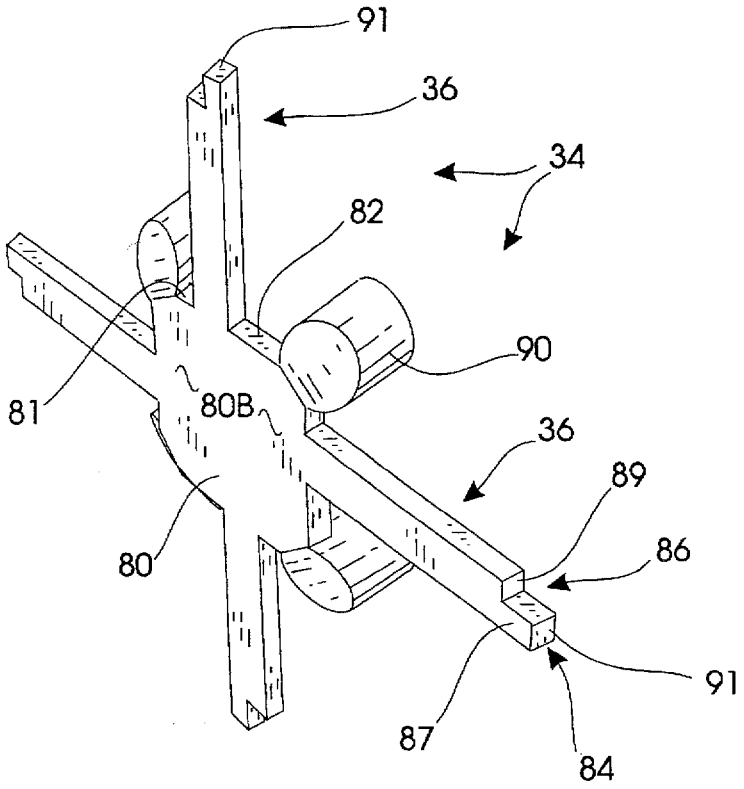
FIG. 8 is an enlarged, rear isometric view of a preferred spider connector, showing its normally inwardly projecting undersurface.

Turning now to FIGS. 7 and 8, each spider connector comprises an inner square hub 80. Each hub 80 includes a surface 80*a* (FIG. 7) normally projecting away from the center block. As seen in FIG. 8, hub 80 includes a rear surface 80*b* normally projecting toward the interior 23 of the block. Each hub 80 preferably comprises peripheral, coplanar edge segments 81, 82 from which arms 36 outwardly project. These radially spaced-apart, integral arms 36 are offset between edge segments 81 and 82; segment 81 is smaller than the associated segment 82. Each offset spider arm 36 is of generally rectangular proportions, terminating in an extremity 87 forming a button 84 (FIG. 8) that, in assembly, penetrates panel follower slots 37 previously described. The spider arm buttons 84 border notches 86. The outermost button thus 91 may clear the follower slots 37 for manipulation by the user. At this time the step portions 89 abut edges of the follower slots 37 and the spiders are thus captivated.

Figure 2:
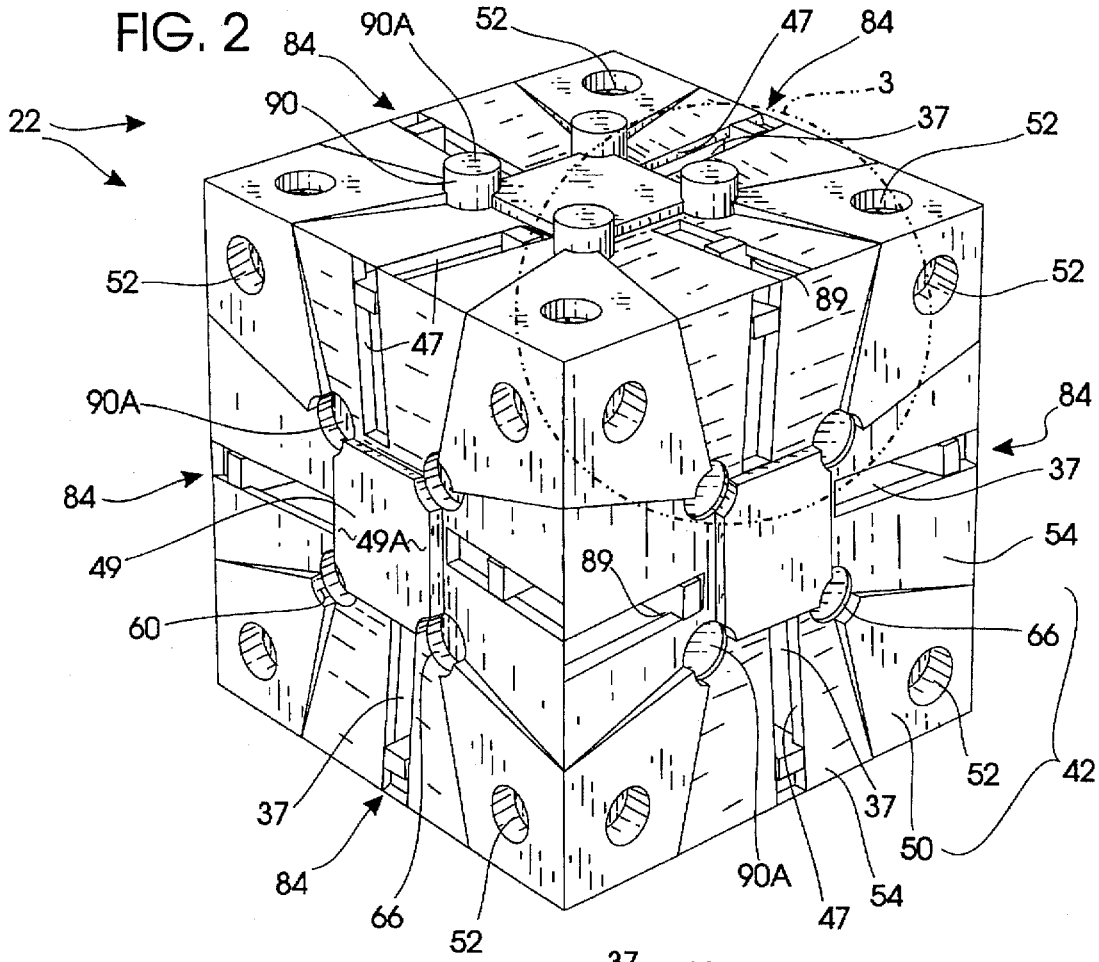
FIG. 2 is an isometric view showing the preferred block construction used in the best mode.
Figure 3:
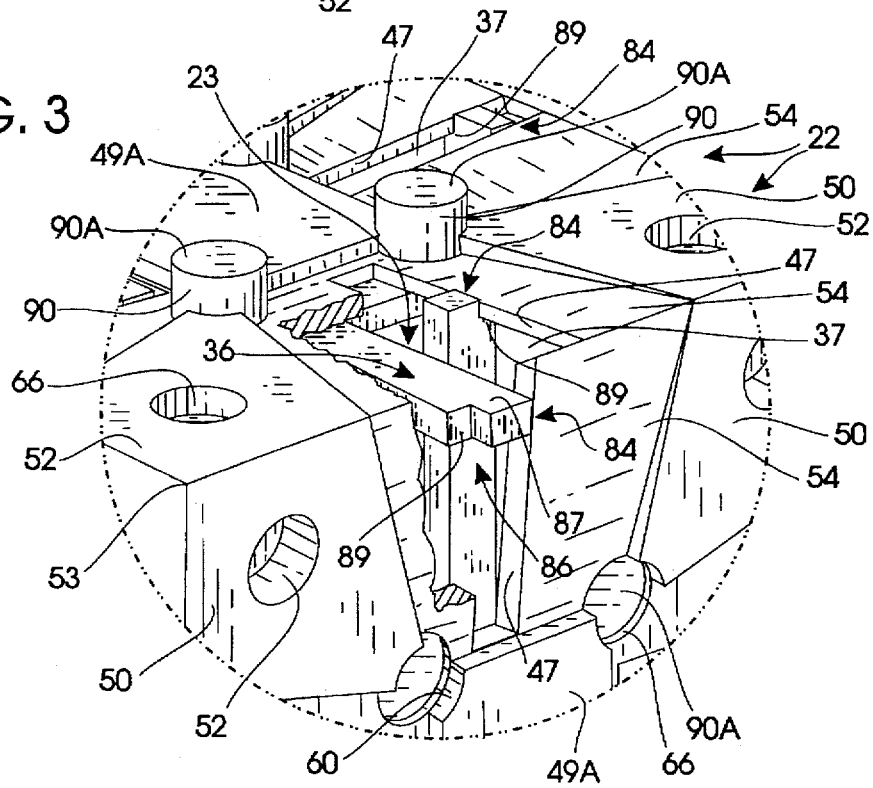
FIG. 3 is an enlarged, fragmentary isometric view of circled portion 3 of FIG. 2.

Thus, as seen best in FIG. 3, the notches 86 will abut the edges 47 within the follower slots 37 for captivation. In this manner the terminal buttons 84 of the spiders may be grasped by the user, as they are exposed at the outside of the block. These spiders may be manipulated by the user and moved toward or away from the viewer, (i.e., as viewed in FIGS. 2 and 3), with the notched buttons 84 captivated within the follower slots 37 for slidable movement inwardly or outwardly with respect to the center 23 of the block.

Each control spider 34 comprises generally cylindrical, control projections 90. These generally cylindrical projections 90 extend from the corners of the hub 80, being radially disposed between adjacent arms 36. Each projection 90 terminates in a flat surface 90*a* that is visible exteriorly of the block (FIGS. 2, 3). As best viewed in FIG. 8, projections 90 extend away from the hub undersurface 80*b*. Their purpose is to switch the blocks between either a male coupling configuration, a female configuration, or a neutral flat configuration. Projections 90, once the apparatus is assembled, travel through connection orifices 66 defined in the panels, concentrically within tubular passageways 67 (FIGS. 5 and 6).

The purpose of the spider projections 90 is to variably occlude the connection orifices, and to selectively project through and outwardly therefrom. When spider movement retracts the control projections 90 towards the block interior 23, the connection orifices 66 are unblocked, and they may be mated to control projections 90 extending from other blocks, or they may be mated to the projections extending from the wedges to be hereinafter described. When spider movement only partially extends the control projections 90 through orifices 66, the panel exterior is "flattened" when projection end surfaces 90*a* (FIG. 7) are disposed flushly with panel surfaces 49A, 50 (FIG. 5). When spider movement fully extends the control projections 90 maximally outwardly through orifices 66, the projections 90 and end surfaces 90*a* project outwardly from orifices 66 and center 49 for possible mating within exposed connection orifices in other blocks, or within aligned holes in system accessories such as wedges 28 (FIG. 1).

Figure 9:
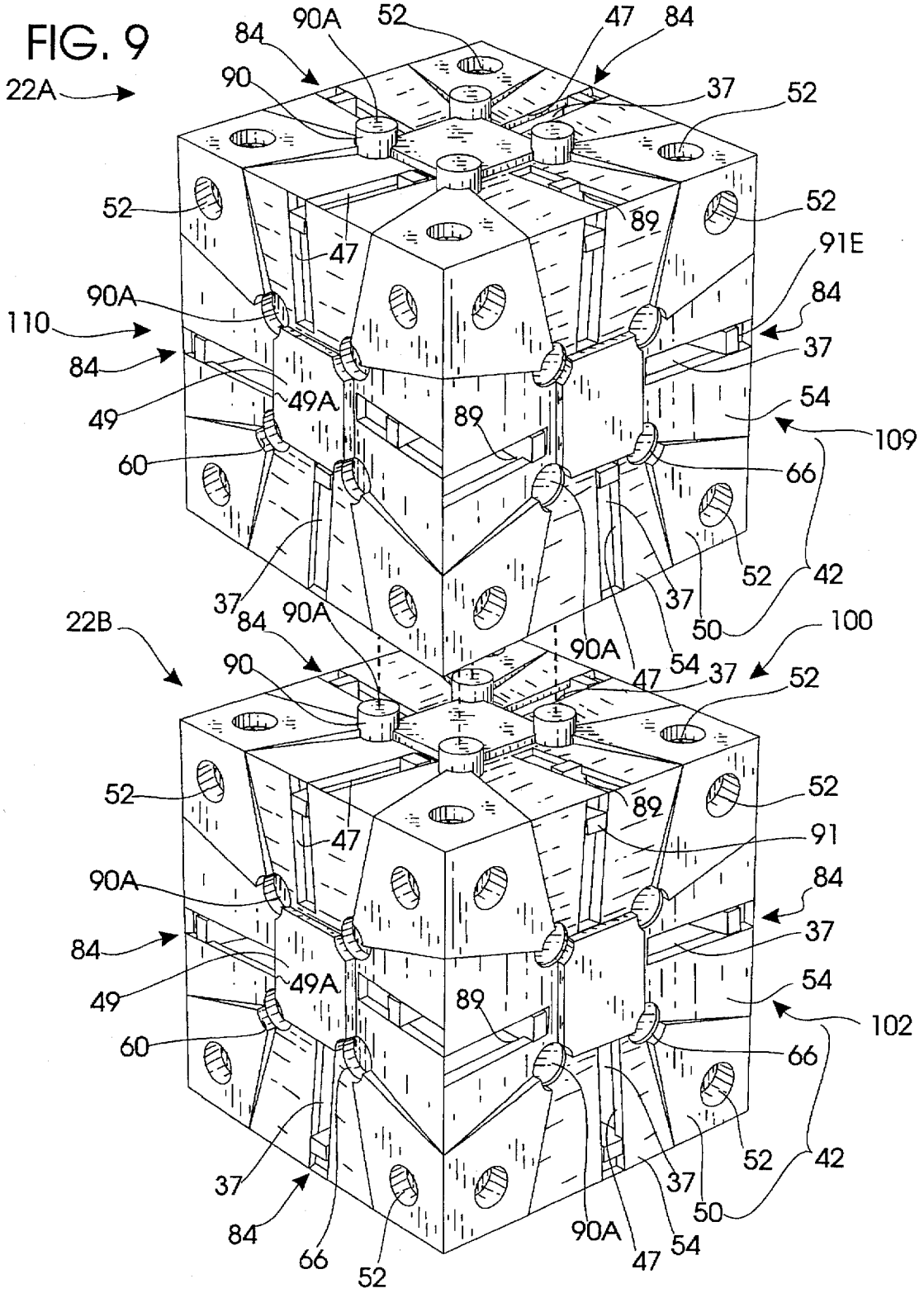
FIG. 9 is a partially exploded, isometric assembly view showing how one block in the system may be connected to a similar block.

With reference now to FIG. 9, it will be clear that equally sized blocks 22*a* and 22*b* (identical with block 22) may be coupled together. Specifically the top 100 of block 22*b* is mated to the bottom of block 22*a* by moving the blocks together. For this to occur, the maximally displaced spider projections 90 rising from "male" block top 100 are fitted within orifices (not seen) in the bottom of block 22*a* that has been configured as "female". Tips 91 from the uppermost spider within lower block 22*b* are grasped by the user to slide the spider away from the block center within follower slot 37 so that cylindrical projections 90 are moved outwardly to form the male configuration. Tips 91E from the lowermost spider within upper block 22*a* slide the spider towards the block center within follower slot 37 so that cylindrical projections 90 are retracted and "female" orifices 66 are exposed for mating.

The two blocks then couple together as indicated by dashed lines in FIG. 9. Of course, it will be appreciated that, at this particular time, other exposed surfaces 109, 110 of block 22*a* may be flattened or changed as desired into male or female configurations. In other words, the actuating spiders captivated within the blocks may be moved as desired to configure the exposed faces of any block 22, 22*a*, 22*b*, or 24 as either flat, male or female. Thus, the spiders can be employed as desired to modify the coupling abilities of the block.

Figure 10:
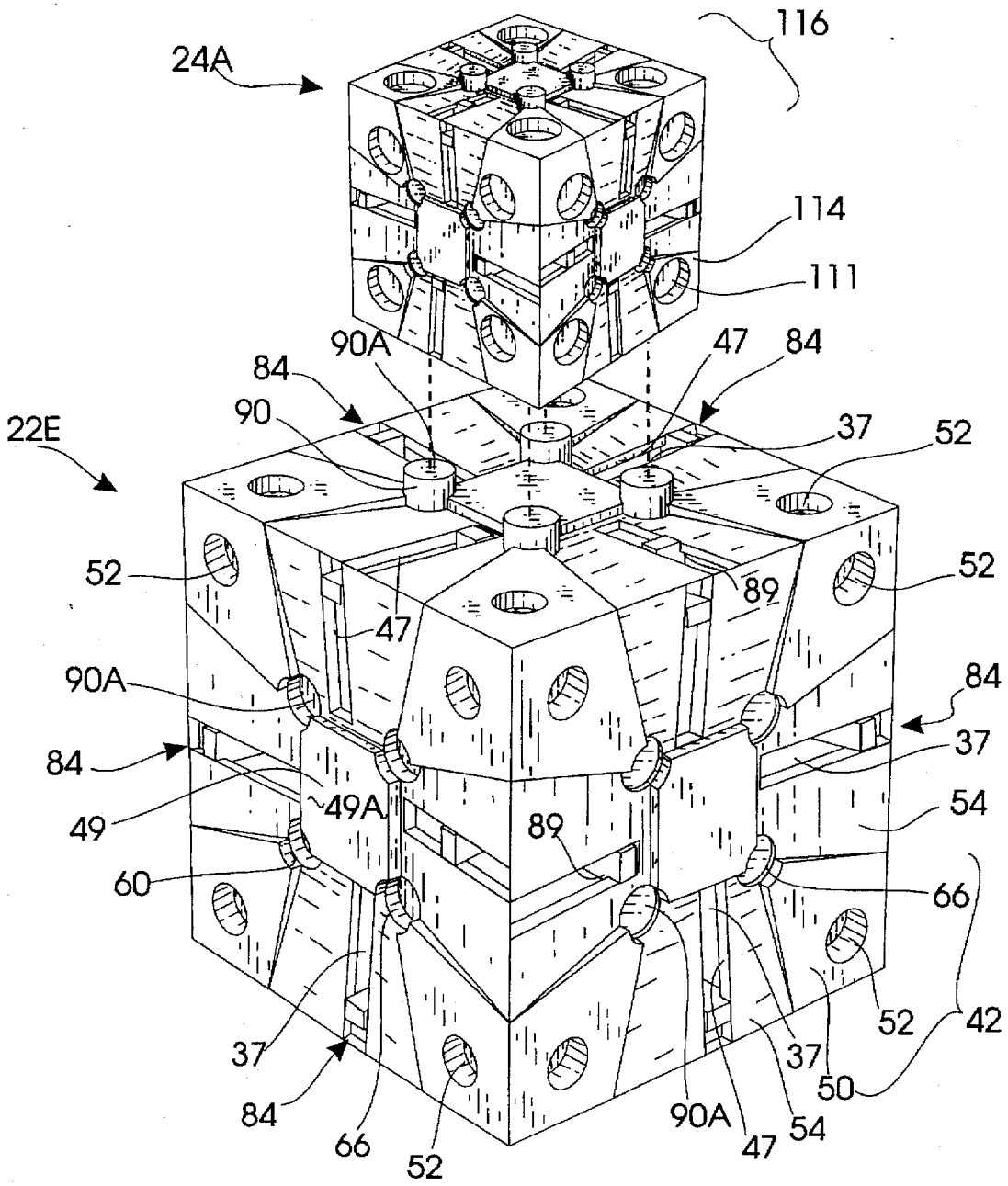
FIG. 10 is a partially exploded, isometric assembly view showing how a large block in the system may be connected to an it identically configured but geometrically smaller block.

FIG. 10 shows how a smaller block such as block 24*a* may be coupled to a relatively larger block 22*e*. Block 24 is substantially identical to block 22 except for size dimensions The spider projections 90 projecting upwardly from the top surface of block 22*e* are received within the corner orifices 111 defined within center, trapezoidal segments 114 of quadrants 116. Corner orifices 111 are similar to corner orifices 52 already discussed. They enable each block to be coupled to larger block.

Figure 11:
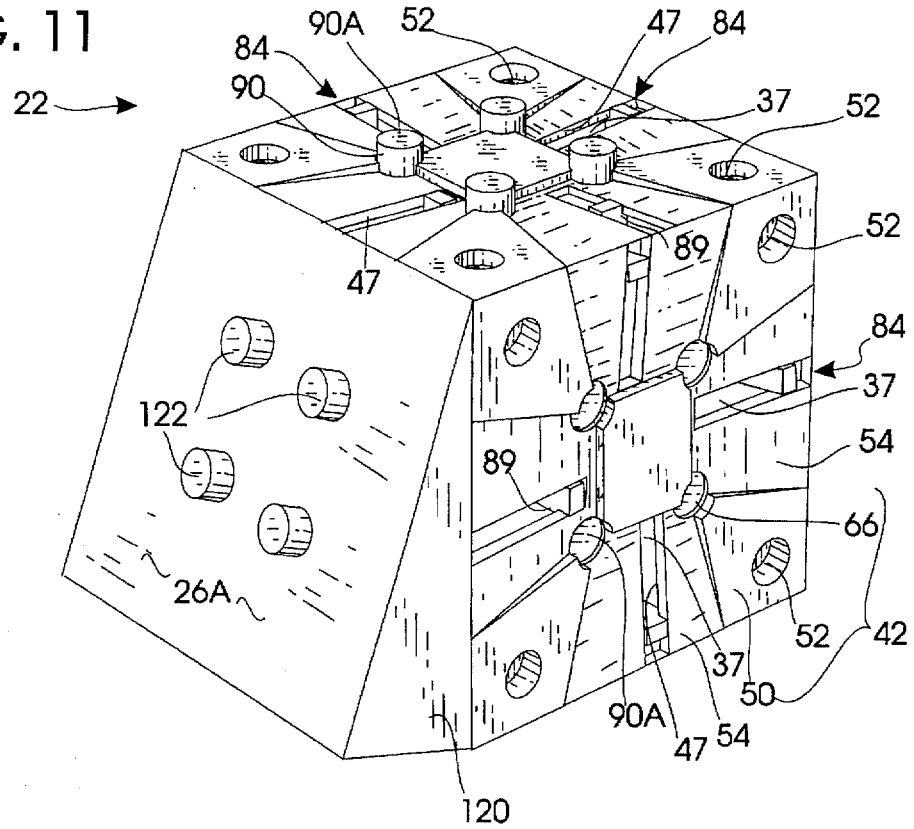
FIG. 11 is an enlarged, isometric view showing one manner in which a preferred block may be connected to a preferred wedge; and, FIG. 12 is an enlarged, isometric view showing one manner in which a preferred block may be connected to a preferred wall segment.

With joint reference now FIGS. 1 and 11, a typical wedge 26 includes generally triangular edges 120 and an outwardly facing surface 26*a* that includes a plurality of fixed, cylindrical projections 122. Of course, an appropriate wedge may be angled wider or narrower than those illustrated. As best seen in FIG. 1, the inner surface 26*b* of each wedge 26 includes suitable orifices 123 that are captivated by suitable projections. In other words, orifices 123 (FIG. 1) may be engaged by cylindrical projections emanating from the surface of a block 22. Similarly they may be snap-fitted to the projections 122 emanating from opposite wedge face 26*a*.

Figure 12:
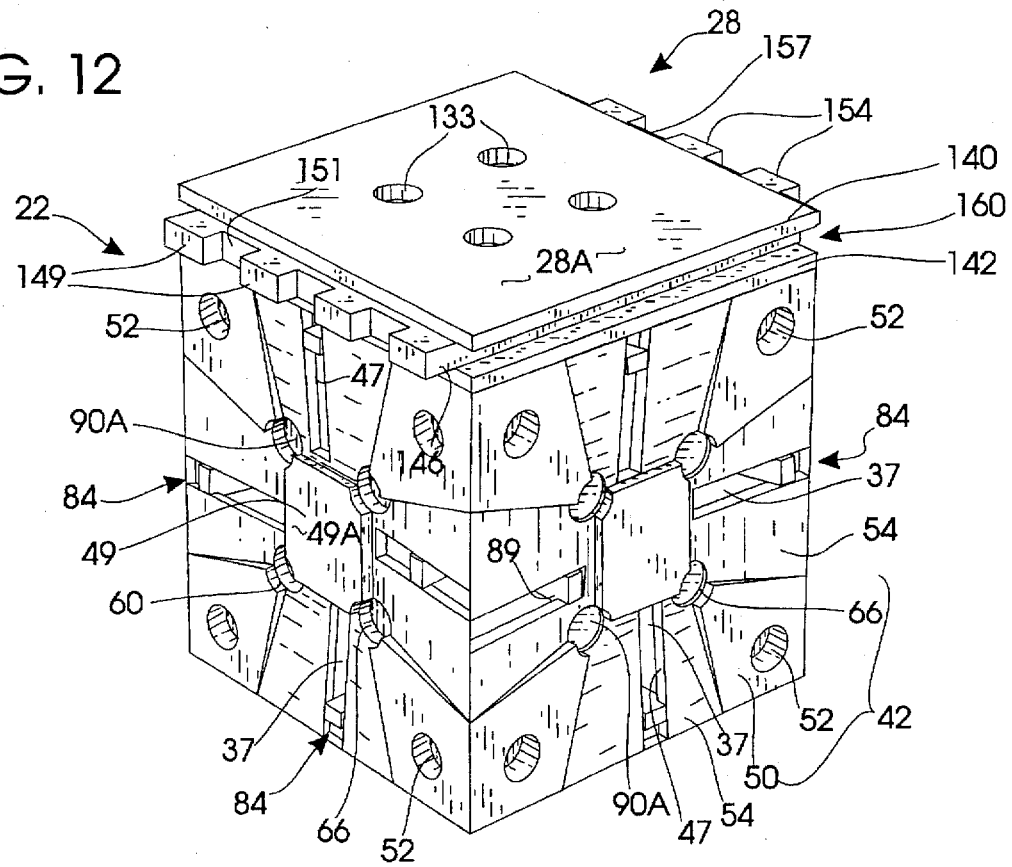

With joint reference now to FIG. 1 and 12, each wall segment comprises a surface 28*a* having a plurality of coupling orifices 133. Coupling orifices 133 may be penetrated by cylindrical projections 122 emanating from wedges 126 or by the cylindrical projections 90 of the spiders previously described that can be configured to extend outwardly from the blocks. Preferably each wall segment includes a planar top 140 that is parallel with planar bottom 142 with a connector grid 146 sandwiched therebetween. One side of grid 146 includes four regularly spaced-apart projections 149 with three notches 151 defined therebetween in the best mode. The opposite edge includes three projections 154 separated by notches 157 adapted to be matingly received by the opposite grid side. In other words, projections 154 may be snapped-fitted into the orifices 151 on a corresponding wall segment. Further, as best viewed in FIGS. 1 and 12, an elongated receptive slot 160 is formed on the opposite edges of the wall segments, between top 140 and bottom 142. This slot will also accept the connectors 149 or the connectors 154. A connection in this manner is shown between wall segments 28*e* and 28*g* in FIG. 1. Alternatively a wall segment 28*h* (FIG. 1) can connect perpendicularly; for example, segment 28*h* connects at right angles to wall segment 28*e*.

It will thus be apparent that a variety of wall segments may be connected about the periphery of segment 28 in FIG. 12. Further, the coupling orifices 133 at the top of the wall segment allow interconnection in a variety of desired manners with all of the other parts aforedescribed. For example, a wall segment may be snap-fitted to any surface of the blocks 22. It may be snap-fitted to the wedged surfaces 26a of any wedge. Further, as seen in FIG. 1, the laterally outwardly extending wall segments 28*g* may be projected outwardly in a plain of desired distance for inner connection to other blocks and wedges in the manner previously described.

From the foregoing, it will be seen that this invention is one well adapted to obtain all the ends and objects herein set forth, together with other advantages that are inherent to the structure. Specifically, the basic block need not be cubical-it can be constructed with unequal sides and still retain functionality. Further, the blocks or parts of this invention can be made in a plurality of shapes and colors. Further, more female recession or male projection can be deployed on walls and wedges to make them connect to a larger or smaller embodiment.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A block configured generally in the form of a parallelepiped and adapted to be coupled to one or more similar blocks, said block comprising:

a plurality of orthogonal panels, each panel comprising:
- a center;
- a plurality of follower slots radially defined about said center through said panel;
- a plurality of connector orifices defined through said panels; and,
- a plurality of peripheral edges, the edges in one panel coupled to abutting edges of an adjacent, orthogonal panel when the block is assembled;

a block interior defined by said panels;

a plurality of spider connectors captivated within said block interior, each spider connector comprising:
- a central hub;
- a plurality of integral, radially spaced apart, arms projecting away from said hub within said block interior towards said panel follower slots for moving the spider connectors;
- a plurality of radially spaced apart control projections aligned with and variably penetrating said connector orifices, said projections controlled by movement of said spiders whereby said panels can be transformed between male, female, and flattened configurations.

2. The block as defined in claim 1 wherein each panel comprises a plurality of identical, radially spaced-apart quadrants separated from integral each other by said follower slots, and wherein the panel quadrants are with and are radially positioned about a solid, panel center.

3. The block as defined in claim 2 wherein each quadrant comprises a middle segment bounded by two recessed segments.

4. The block as defined in claim 3 further comprising corner orifices defined in each panel and diagonally aligned with said connector orifices to facilitate connection with larger blocks that are similarly configured.

5. The block as defined in claim 1 wherein each of the arms of the spider connectors are offset to interiorly clear one another when assembled.

6. The block as defined in claim 5 wherein each spider arm terminates in a user accessible button penetrating one of said followers slots.

7. A dynamic block system comprising one or more similar blocks configured generally in the form of a regular parallelepiped and adapted to be interfitted with one another, each block comprising:

a plurality of orthogonal panels, each panel comprising:

a center;

a plurality of follower slots radially defined about said center through said panel;

a plurality of connector orifices defined through said panels;

a block interior defined by said panels;

a plurality of movable spider connectors captivated within said block interior, each spider connector comprising:

a central hub;

a plurality of integral, radially spaced apart, arms projecting away from said hub within said block interior towards said panel follower slots so a user can access them externally of said block and move the spider connectors;

a plurality of radially spaced apart control projections aligned with and variably penetrating said connector orifices;

whereby said panels are dynamically transformable between male and female connection configurations depending upon movement of the spiders and the spider control projections.

8. The system as defined in claim 7 wherein each panel comprises a plurality of identical, radially spaced-apart quadrants separated from an adjacent quadrant by said follower slots.

9. The system as defined in claim 8 wherein the panel quadrants are integral with and are radially positioned about a solid, panel center.

10. The system as defined in claim 9 wherein each quadrant comprises a middle segment bounded by two recessed segments.

11. The system as defined in claim 7 including corner orifices defined in each panel and diagonally aligned with said connector orifices enabling block connection with larger blocks.

12. The system as defined in claim 7 wherein the spider connector arms are offset to interiorly clear one another when assembled, and wherein each spider arm terminates in a user accessible button penetrating a follower slot.

13. The system as defined in claim 7 further comprising at least one wedge adapted to be coupled to either one of said blocks or to another wedge, each wedge comprising connection orifices and connection projections.

14. The system as defined in claim 7 further comprising generally planar wall segments that can be connected to one of said blocks or to one another to form either a planar surface or a perpendicular connection.

15. A modular block system comprising a plurality of similar, generally cubicle blocks adapted to be interfitted with one another, each block comprising:

a plurality of orthogonal panels comprising:

peripheral edges adapted to be coupled to adjacent edges of abutting panels;

a plurality of radially spaced apart follower slots;

a plurality of connector orifices defined through said panels; and, a plurality of internal spider connectors comprising:

a plurality of integral, offset, and radially spaced apart arms projecting towards said panel follower slots so a user can access them externally of said block and move the spider connectors;

a plurality control projections aligned with and variably penetrating said connector orifices;

whereby said panels can be transformed between male, female, and flattened configurations by movement of the spider control projections within said connector orifices.

16. The system as defined in claim 15 including nubs and sockets formed in said peripheral edges adapted to be coupled together to fasten abutting panels.

17. The system as defined in claim 15 including corner orifices defined in each panel and diagonally aligned with said connector orifices enabling block connection with larger blocks.

18. The system as defined in claim 15 wherein each spider arm terminates in a user accessible button penetrating one of said follower slots.

19. The system as defined in claim 15 further comprising at least one wedge adapted to be coupled to either one of said blocks or to another wedge, each wedge comprising connection orifices and connection projections.

20. The system as defined in claim 19 further comprising generally planar wall segments that can be connected to one of said blocks, to one wedge, or to one another to form either a planar surface or a perpendicular connection.

* * * * *